US010281875B2

(12) United States Patent
Tachibe et al.

(10) Patent No.: US 10,281,875 B2
(45) Date of Patent: May 7, 2019

(54) OPTICAL SCANNING DEVICE AND IMAGE FORMING DEVICE HAVING THE SAME

(71) Applicant: Konica Minolta, Inc., Chiyoda-ku, Tokyo (JP)

(72) Inventors: Hidenari Tachibe, Toyokawa (JP); Akira Taniyama, Hino (JP); Takafumi Yuasa, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/902,563

(22) Filed: Feb. 22, 2018

(65) Prior Publication Data

US 2019/0064733 A1 Feb. 28, 2019

(30) Foreign Application Priority Data

Feb. 23, 2017 (JP) ..... 2017-032460

(51) Int. Cl.
*G03G 21/20* (2006.01)
*G03G 15/04* (2006.01)

(52) U.S. Cl.
CPC ..... *G03G 21/20* (2013.01); *G03G 15/04036* (2013.01); *G03G 2221/1645* (2013.01)

(58) Field of Classification Search
None
See application file for complete search history.

(56) References Cited

U.S. PATENT DOCUMENTS

2009/0023252 A1* 1/2009 Inomata ..... H01L 23/367 438/122
2009/0067779 A1* 3/2009 Furuyama ..... G02B 6/43 385/14
2015/0239258 A1* 8/2015 Yano ..... B41J 2/45 347/247
2016/0268179 A1* 9/2016 Hiruta ..... H01L 23/3675

FOREIGN PATENT DOCUMENTS

JP 2011245775 A 12/2011
JP 2016058484 A 4/2016

* cited by examiner

*Primary Examiner* — Victor Verbitsky
(74) *Attorney, Agent, or Firm* — Cantor Colburn LLP

(57) ABSTRACT

A print head includes a platform with a face whose portion covered with a heat conductor includes a heat release section, which is deformed relative to a substantially flat portion of the face of the platform to be located at a smaller distance from the surface of the chip in a direction normal to the face at a side near to the light emission area in the longitudinal direction of the light source panel than at another side far from the light emission area. Alternatively, the heat conductor, when disconnected from the face of the platform, is thicker at a side near to the light emission area in the longitudinal direction of the light source panel than at another side far from the light emission area.

15 Claims, 8 Drawing Sheets

OPTICAL SCANNING DEVICE AND IMAGE FORMING DEVICE HAVING THE SAME

CROSS REFERENCE TO RELATED APPLICATION

The present application claims priority under 35 U.S.C. § 119 to Japanese Application No. 2017-032460 filed Feb. 23, 2017, the entire content of which is incorporated herein by reference.

BACKGROUND

1. Technical Field

The invention relates to electrophotographic image forming devices, and in particular, a heat dissipation structure of a print head for exposure of a photoreceptor.

2. Related Art

A print head in an electrophotographic image forming device such as a printer or a copier exposes a photoreceptor surface, i.e. irradiates a uniformly charged area of the photoreceptor surface with a light beam modulated by image data, thus forming a charge distribution in a pattern corresponding to the modulated exposure, i.e. an electrostatic latent image. The photoreceptor covers the outer circumferential surface of a rotator such as a drum and a belt, rotatably supported in the image forming device. The print head exposes each linear area extending in the axial direction of the rotator on the photoreceptor surface. Each of the linear areas is hereinafter referred to as a "line," and the axial direction of the rotator is hereinafter referred to as "main scanning direction." In synchronization with rotation of the photoreceptor, the print head repeats exposure of each line. This results in a plurality of exposed lines on the photoreceptor surface in the rotating direction, which is hereinafter referred to as "sub-scanning direction," and thus the electrostatic latent image extends two-dimensionally.

Many current print heads are of an optical scanning type using deflectors such as polygon mirrors. On the other hand, recent development of print heads primarily targets a "light-emitting-element-array type." This type of print head uses an array of light-emitting elements such as light-emitting diodes (LEDs) and semiconductor lasers, and an array of gradient index lenses, which are aligned in the main scanning direction, to expose the entirety of one line on the photoreceptor surface at once. In contrast to the optical scanning type, the light-emitting-element-array type has lower noise since it does not use any deflector, and has shorter light paths from the light-emitting elements and the photoreceptor surface since the light-emitting elements and gradient-index (GRIN) lenses irradiate their respective target areas of one line. As a result, the light-emitting-element-array type has an advantage in noise- and size-reduction over the optical scanning type. It is accordingly expected that application of the light-emitting-element-array type is effective in increasing uptake of the image forming devices such as laser printers especially in offices and homes.

Positioning of the print head relative to the photoreceptor is important in application of the light-emitting-element-array type. Since the GRIN lenses have narrower focus depths than the optical system of the optical scanning system, the image surface of the light-emitting elements made by the GRIN lenses have to be reliably aligned with the photoreceptor surface in order to accurately expose the photoreceptor surface. Accordingly, the light-emitting elements are required to be positioned with high precision relative to the photoreceptor surface. For example, a positioning structure disclosed in JP 2011-245775 has a spacer between the bearing of a photoreceptor and a light source to limit the distance from the rotation axis of the photoreceptor to the surface of the light source to a predetermined value. In addition, this distance is adjustable in each product because of an eccentric cam included in the portion of the spacer that touches the surface of the light source.

Heat release from the print head is also important in application of the light-emitting-element-array type. Since the print head includes a number of the light-emitting elements, not only the light-emitting elements but also their driver circuits generate a huge amount of heat. In order to prevent errors caused by overheating, efficient heat release from a base plate in which the light-emitting elements and driver circuits are implemented is required. For example, an electronic control unit disclosed in JP 2016-058484 has a thermal interface material (TIM) between a power transistor element and an aluminum alloy housing. The TIM such as silicone grease, a room temperature vulcanizing silicone rubber, or a silicone sheet allows heat transferred from the power transistor element to efficiently escape to the housing. When a heat conductor such as the TIM is put between the light source panel and an appropriate heat sink such as a metallic platform supporting the panel, the efficiency of heat dissipation from the light source panel can be further improved.

SUMMARY

More sophisticated print heads of the light-emitting-element-array type are sought. As a technology for increasing sophistication, application of organic light-emitting diodes (OLEDs) as the light source is considered. OLEDs have an advantage over LEDs in having a lower black level, higher color performance, lower power consumption, and easier reduction in size, thickness, and weight. On the other hand, OLEDs have less amounts of luminescence than LEDs. Accordingly, application of OLEDs requires increase in F value of the GRIN lenses. Since increase in F value causes reduction in focus depth, positioning of the light-emitting elements relative to the photoreceptor surface requires further higher precision.

Application of heat conductors to heat release from the light source panels, however, prevents the positioning with further higher precision for the following reasons. When grease is used as a heat conductor in positioning of the light source panel on the platform, clearances between the platform and light source panel, esp. its driver circuit chip, is filled with the grease after the light source panel is fixed to the platform. When a sheet is used as a heat conductor, one of the platform and light source panel, esp. its driver circuit chip, is covered with the sheet, and then stuck to the other with the sheet in between. In both the cases, the portion of the light source panel that touches the heat conductor, esp. the portion on which the driver circuit chip is mounted receives a pushing force from the heat conductor. Since the portion is generally located at a distance from the portion of the light source panel that is supported by the platform, the light source panel undergoes a deflection caused by the difference in stress between the touching portion and the supported portion. If the deflection causes excessive dislocation of the light-emitting elements, the distances from the photoreceptor surface to the light-emitting elements significantly deviate from their target value. This risk is unavoidable, thus preventing the positioning of the light-emitting elements relative to the photoreceptor surface with further higher precision.

An object of the invention is to solve the above-mentioned problems, and in particular, to provide a print head capable of suppressing deflection of the light source panel caused by the pushing force from the heat conductor when the clearances between the light source panel and platform are connected by the heat conductor.

A print head according to one aspect of the invention includes a light source panel, a platform, and a heat conductor. The light source panel is shaped as an elongated plate, and includes a light emission area and a chip. The light emission area extends in the longitudinal direction of the plate. The chip is mounted on an edge portion of the plate in the longitudinal direction and incorporates a driver circuit for the light emission area. The platform has a substantially flat face, and supports the light source panel in a vicinity of the light emission area to position the light source panel substantially parallel to the face at a predetermined distance from the face. The heat conductor heat-conductively connects between a surface of the chip and the face of the platform, and covers a portion of the face of the platform. The portion includes a heat release section deformed relative to the substantially flat portion of the face of the platform wherein a side of the heat release section nearer to the light emission area in the longitudinal direction of the light source panel is closer to the surface of the chip in a direction normal to the face than another side of the heat release section farther from the light emission area.

A print head according to another aspect of the invention includes a light source panel, a platform, and a heat conductor. The light source panel is shaped as an elongated plate, and includes a light emission area and a chip. The light emission area extends in the longitudinal direction of the plate. The chip is mounted on an edge portion of the plate in the longitudinal direction and incorporates a driver circuit for the light emission area. The platform has a substantially flat face, and supports the light source panel in a vicinity of the light emission area to position the light source panel substantially parallel to the face at a predetermined distance from the face. The heat conductor heat-conductively connects between a surface of the chip and the face of the platform, and is thicker at a side near to the light emission area in the longitudinal direction of the light source panel than at another side far from the light emission area when the heat conductor is disconnected from either the surface of the chip or the face of the platform.

An image forming apparatus according to one aspect of the invention is an image forming apparatus of the electrophotographic type that includes a photoreceptor, a developer, and a transfer device, in addition to one of the above-described print heads. The print head exposes a surface of the photoreceptor to a light beam and forms an electrostatic latent image on the surface. The developer converts the latent image to a visible image with toner. The transfer device transfers the visible image from the photoreceptor to a sheet.

BRIEF DESCRIPTION OF THE DRAWINGS

The advantages and features provided by one or more embodiments of the invention will become more fully understood from the following description taken in conjunction with the accompanying drawings which are given by way of illustration only, and thus are not intended as a definition of the limits of the invention. In the drawings.

DETAILED DESCRIPTION

The following is a description of embodiments of the invention with reference to the drawings.

First Embodiment

—Appearance of Image Forming Apparatus—

Figure 1A:
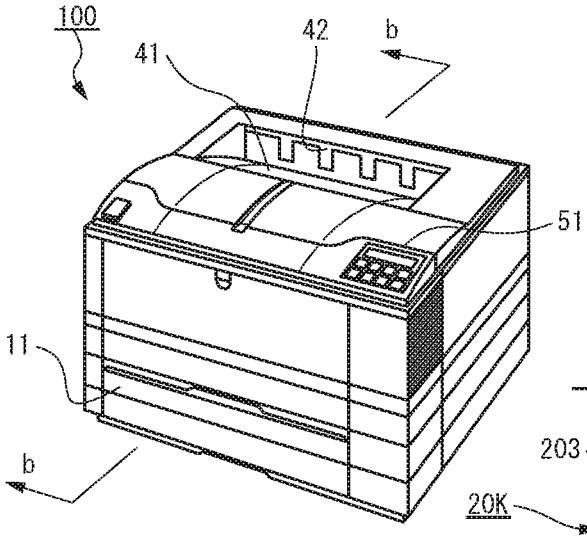
FIG. 1A is a perspective view of an appearance of an image forming apparatus according to an embodiment of the invention.

FIG. 1A is a perspective view of the appearance of an image forming apparatus 100 according to a first embodiment of the invention. This image forming apparatus 100 is a printer, which has, on the top of its body, an ejection tray 41 that stores sheets ejected from an ejection slot 42 located deep in the tray. The printer 100 also has, in front of the ejection tray 41, an operation panel 51 embedded, and in the bottom of its body, paper cassettes 11 attached to be able to slide out like drawers.

—Internal Configuration of Printer—

Figure 1C:
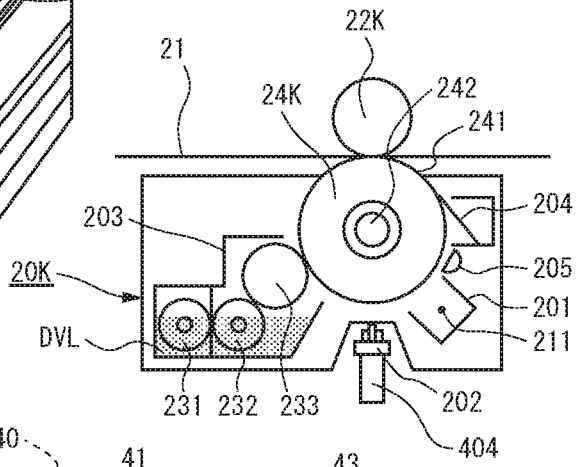
FIG. 1C is an enlarged view of a photoreceptor unit shown in FIG. 1B.
Figure 1B:
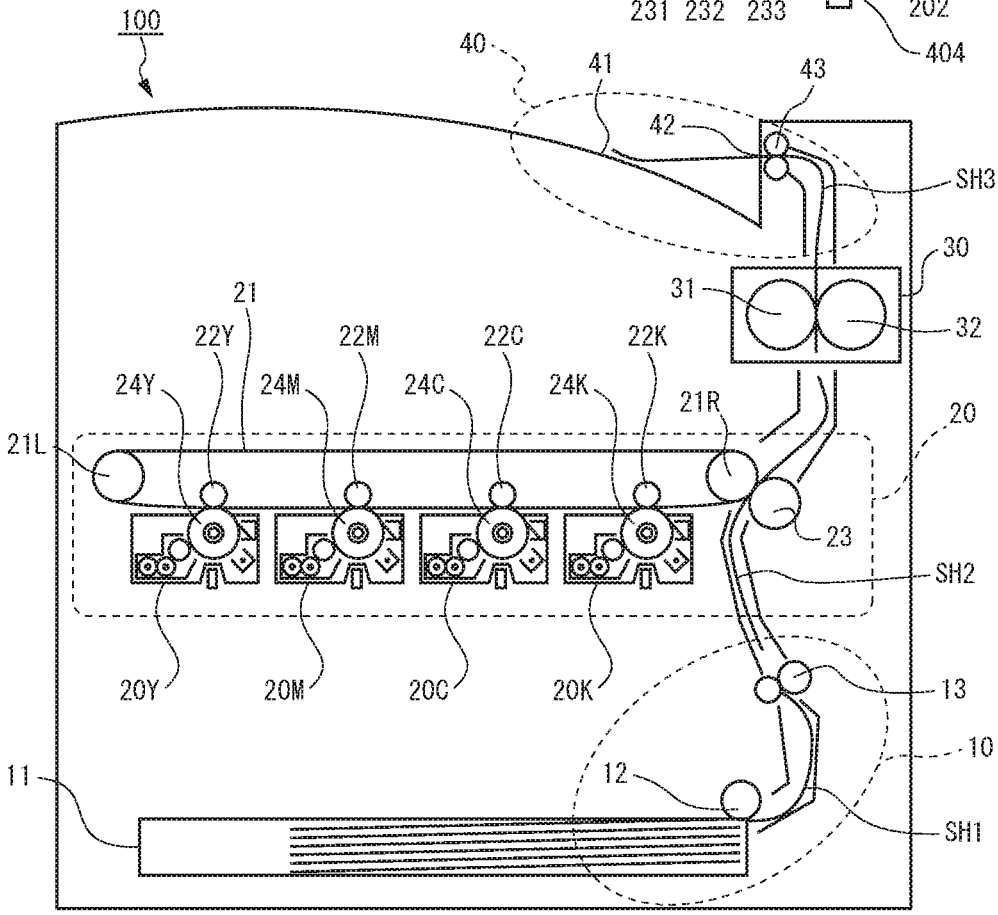
FIG. 1B is a schematic cross-sectional view of a printer along the line b-b shown in FIG. 1A.

FIG. 1B is a schematic cross-sectional view of the printer 100 along the line b-b shown in FIG. 1A. The printer 100, which is an electrophotographic type capable of color printing, includes a feeder device 10, an imaging device 20, a fuser device 30, and an ejecting device 40.

The feeder device 10 first, with a pickup roller 12, separates each sheet SH1 from a stack of sheets stored in a paper cassette 11, and next, with a timing roller 13, feeds each separated sheet to the imaging device 20 in synchronization with the action of the imaging device 20. The term "sheets" means film-, or thin-plane-shaped materials, products, or print pieces made of paper or resin. Paper types, i.e. types of sheets storable in the paper cassette 11 include plain, high-quality, color-copier, coated, etc.; and sizes of the sheets include A3, A4, A5, B4, etc. The sheets can be stored in the longitudinal or transverse orientation.

The imaging device 20 is, for example, a printing engine of intermediate transfer type, which includes four tandem photoreceptor units 20Y, 20M, 20C, 20K, an intermediate transfer belt 21, four primary transfer rollers 22Y, 22M, 22C, 22K, and a secondary transfer roller 23. The intermediate transfer belt 21 wraps around a driven pulley 21L and a driving pulley 21R. In a space between these pulleys 21L and 21R, the four photoreceptor units 20Y-20K and the four primary transfer rollers 22Y-22K are arranged such that each of the photoreceptor units is paired with one of the primary transfer rollers with the intermediate transfer belt 21 in between. The secondary transfer roller 23, along with the driving pulley 21R, forms a nip with the intermediate transfer belt 21 in between. Into this nip, a sheet SH2 is sent by the timing roller 13.

In the photoreceptor units 20Y-20K, their respective photoreceptor drums 24Y-24K, along with the primary transfer rollers 22Y-22K facing the drums across the intermediate transfer belt 21, form nips with the belt in between. During rotation of the intermediate transfer belt 21, which is counterclockwise rotation in FIG. 1B, the photoreceptor units 20Y-20K, when accepting the same surface portion of the intermediate transfer belt 21 passing through the nips between their respective photoreceptor drums 24Y-24K and the primary transfer rollers 22Y-22K, form on the same surface portion of the belt monochromatic toner images of their respective colors, i.e., yellow (Y), magenta (M), cyan (C), and black (K). These four monochromatic toner images overlap onto the same surface position of the belt and form a single polychromatic toner image. Synchronized with when this polychromatic toner image passes through the nip between the driving pulley 21R and the secondary transfer roller 23, a sheet SH2 is sent from the timing roller 13 to the nip. At the nip, the polychromatic toner image is thus transferred from the intermediate transfer belt 21 onto the sheet SH2.

The fuser device 30 thermally fixes a toner image to the sheet SH3 conveyed from the imaging device 20. More specifically, the fuser device 30 rotates a fuser roller 31 and a pressure roller 32, and the sheet SH3 is sent to the nip therebetween. Then, the fuser roller 31 applies heat to the surface of the sheet SH3, and the pressure roller 32 applies pressure to the same surface of the sheet SH3 to press the surface against the fuser roller 31. Due to the heat from the fuser roller 31 and the pressure from the pressure roller 32, the toner image is fixed onto the surface of the sheet SH3. The fuser device 30 further conveys the sheet SH3 to the ejecting device 40 by rotation of the fuser roller 31 and pressure roller 32.

The ejecting device 40 ejects the sheet SH3 with a toner image fixed from the ejection slot 42 to the ejection tray 41. More specifically, the ejecting device 40 uses ejecting rollers 43, which are disposed inside of the ejection slot 42, to eject the sheet SH3 coming from the top portion of the fuser device 30 to the ejection slot 42 and store it on the ejection tray 41.

—Configuration of Photoreceptor Unit and Image Forming Process by the Unit—

FIG. 1C is an enlarged view of one 20K of the photoreceptor units shown in FIG. 1B. This photoreceptor unit 20K includes a charger section 201, print head 202, developer section 203, cleaning blade 204, and eraser 205, in addition to the photoreceptor drum 24K. These functional sections 201-205 are arranged around the photoreceptor drum 24K, and perform an electrophotographic image forming process for the outer circumferential surface of the photoreceptor drum 24K except for fusing, i.e. charging, exposing, developing, transferring, cleaning, and neutralizing. Other photoreceptor units 20Y, 20M, 20C also have the same configuration.

The photoreceptor drum 24K is a drum-shaped member made of an electric conductor such as aluminum, with the outer circumferential surface 241 covered with photoreceptor. The photoreceptor drum 24K is supported rotatably around its center axis 242, the axis being normal to the plane of FIG. 1C at the center of the circular cross section of the photoreceptor drum 24K. The photoreceptor is a material that has varying charge amounts depending on exposures, for example, inorganic material such as amorphous selenium, selenium alloy, and amorphous silicon, or laminated structure of organic photoconductors (OPCs). Although not shown in FIG. 1C, the center axis 242 of the photoreceptor drum 24K is connected to a driving motor through a torque transmission mechanism such as gears and belts. When receiving torque from the motor, the photoreceptor drum 24K rotates one revolution, clockwise in FIG. 1C, and then surface portions of the photoreceptor in turn face the surrounding functional sections 201-205 and are processed by them.

The charger section 201 includes an electrode 211 shaped as a wire or a thin plate, which is located at a distance from the outer circumferential surface 241 of the photoreceptor drum 24K and extends in the axial direction of the drum. The charger section 201 applies to the electrode 211, for example, a negative high voltage to cause corona discharge between the electrode 211 and the outer circumferential surface 241 of the photoreceptor drum 24K. This discharge provides negative charge to the surface portion of the photoreceptor facing the charging section 201.

The print head 202, which here is a print head according to the first embodiment of the invention, exposes a linear area extending in the axial direction (main scanning direction), i.e. one line, in the charged area on the photoreceptor drum 24K. In parallel, the print head 202 modulates amounts of the beam emitted to the photoreceptor drum 24K based on brightness represented by image data. On the line on the photoreceptor drum 24K, areas receiving the larger beam amounts lose larger charge amounts, and thus a charge distribution corresponding to a brightness distribution represented by the image data, i.e. an electrostatic latent image is formed. The print head 202 repeats such an exposure action for one line in synchronization with rotation of the photoreceptor drum 24K. This results in a plurality of exposed lines on the outer circumferential surface of the photoreceptor drum 24K in its rotating direction (sub-scanning direction), and thus an electrostatic latent image extends two-dimensionally.

The developer section 203 develops the electrostatic image on the photoreceptor drum 24K with K-colored toner. More concretely, the section 203 first agitates dual-component developer DVL with two auger screws 231 and 232, and causes friction to provide negative charge to toner contained in the developer DVL. The section 203 next uses a developer roller 233 to carry the developer DVL to the nip between the roller 233 and the drum 24K. In parallel, the section 203 applies negative high voltage to the roller 233 to raise the electric potential of areas with a relatively small amount of charge in the electrostatic latent image. From the toner carried by the roller 233, an amount of toner corresponding to a reduced amount of charge is separated and migrates to the areas, converting the electrostatic latent image into a visible toner image.

Rotation of the photoreceptor drum 24K moves the toner image to the nip between the drum 24K and the primary transfer roller 22K. Since positive high voltage is applied to the roller 22K, the negatively charged toner image is transferred from the outer circumferential surface of the drum 24K to the intermediate transfer belt 21.

The cleaning blade 204 is a thin rectangular plate made of, for example, thermosetting resin such as polyurethane rubber. The blade 204 has nearly the same length as an area covered with the photoreceptor on the outer circumferential surface 241 of the photoreceptor drum 24K. A side of the blade 204 that faces the outer circumferential surface 241 of the drum 24K has a longer edge parallel to the axial direction of the drum 24K and in contact with the surface 241, thus using the edge to remove residual toner from the trace of a toner image. As a result, the blade 204 cleans the surface 241 of the drum 24K.

The eraser 205 has LEDs aligned, for example, in the axial direction of the photoreceptor drum 24K, and from them, emits light to the outer circumferential surface 241 of the drum 24K. Since areas of the surface 241 receiving the light lose residual charge, the eraser 205 removes charge from the surface 241.

—Configuration of Print Head—

Figure 2A:
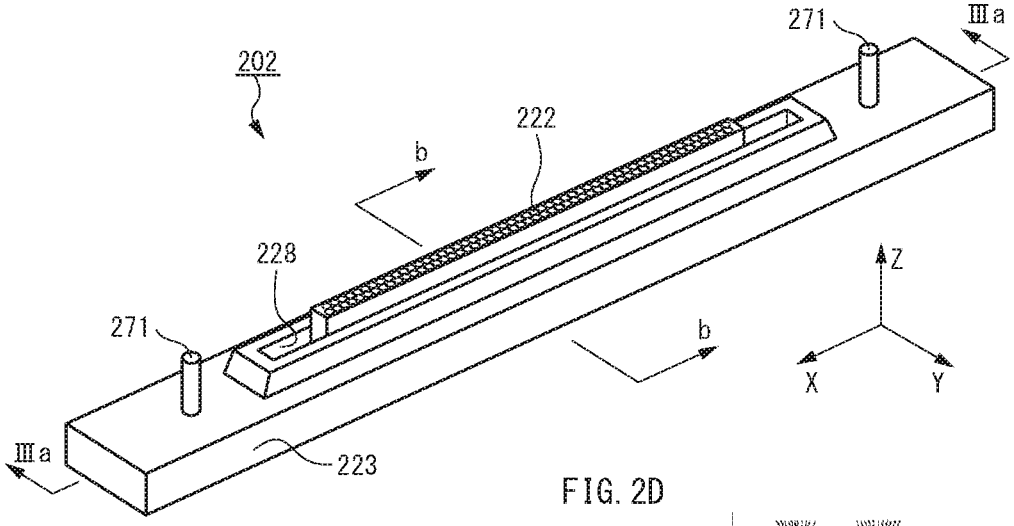
FIG. 2A is a perspective view of a print head shown in FIG. 1B and FIG. 1C.
Figure 2B:
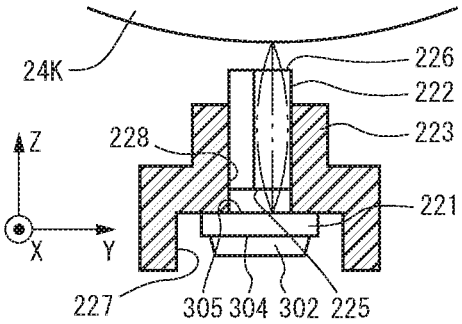
FIG. 2B is a transverse cross-sectional view of the print head along the line b-b shown in FIG. 2A.
Figure 3A:
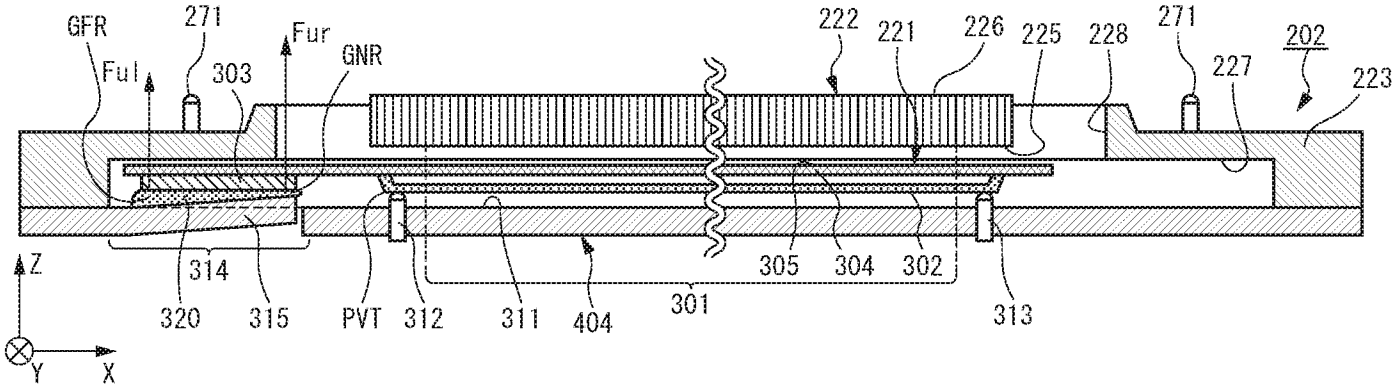
FIG. 3A is a longitudinal cross-sectional view of a print head along the line IIIa-IIIa shown in FIG. 2A.

FIG. 2A is a perspective view of the print head 202, FIG. 2B is a transverse cross-sectional view of the print head 202 along the line b-b shown in FIG. 2A, and FIG. 3A is a longitudinal cross-sectional view of the print head 202 along the line IIIa-IIIa shown in FIG. 2A. The print head 202 is of a light-emitting-element-array type and includes a light source panel 221, a lens array 222, and a holder 223.

The light source panel 221 is an elongated transparent plate made of glass or resin, and includes a light emission area 301, seal layer 302, and integrated circuit (IC) chip 303. The light emission area 301 is an area extending in the longitudinal direction of the light source panel 221, the X-axis direction in FIG. 2B, FIG. 3A, through almost the entirety of the light source panel 221. The light emission area 301 has a plurality of solid-state light-emitting elements such as LEDs and OLEDs formed directly on a first surface 304 of the light source panel 221, its lower surface in FIG. 2B, FIG. 3A. Light beams emitted from these elements penetrate the light source panel 221 and escape from a second surface 305 of the light source panel 221, its upper surface in FIG. 2B, FIG. 3A, in the normal direction of the second surface 305, the positive direction of the Z axis in FIG. 2B, FIG. 3A. The seal layer 302 has a laminate structure with alternating layers of metal oxide or nitride and polymer, and hermetically encloses the light emission area 301 on the first surface 304 in insulation from outside, thus protecting the light emission area 301 from moisture and oxygen in the external air. The chip 303 is shaped as a box elongated in the longitudinal (X-axis) direction of the light source panel 221, and mounted on the first surface 304 of the plate 221 at its edge portion in the longitudinal direction. The chip 303 incorporates a driver circuit for the light emission area.

The lens array 222 is an optical member made of transparent glass or resin, and shaped as a rectangular board elongated in the longitudinal (X-axis) direction of the light source panel 221. The lens array 222 contains rows of GRIN lenses sealed between its two board surfaces. Each GRIN lens receives a beam entering its one end surface 225 from the light source panel 221, and emits the beam from the other end surface 226 to focus it on the outer circumferential surface of the photoreceptor drum 24K.

The holder 223 is a plate elongated in the longitudinal (X-axis) direction of the light source panel 221, and made of resin, for example. The holder 223 includes a hollow 227 on one plate surface, its lower surface in FIG. 2B, FIG. 3A, and a slit 228 in the other plate surface, its upper surface in FIG. 2B, FIG. 3A. The hollow 227 and the slit 228 have inner spaces communicated with each other. The holder 223 allows the light source panel 221 to be placed in the hollow 227, and holds the lens array 222 inside the slit 228.

—Light Source Panel—

Figure 2D:
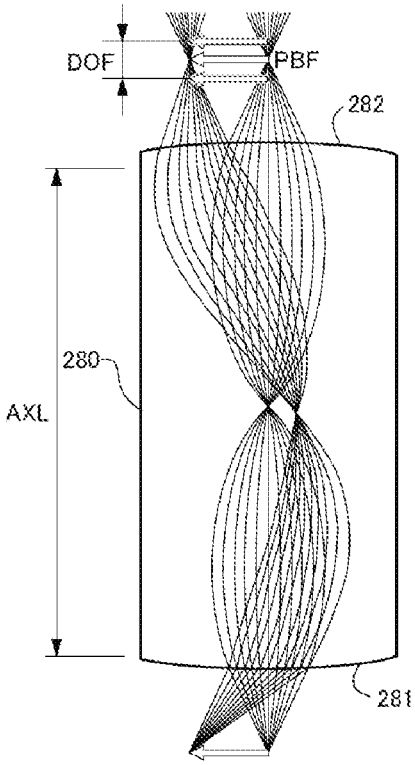
FIG. 2D is a schematic diagram indicating light paths in one GRIN lens in a lens array shown in FIG. 2A and FIG. 2B.
Figure 2C:
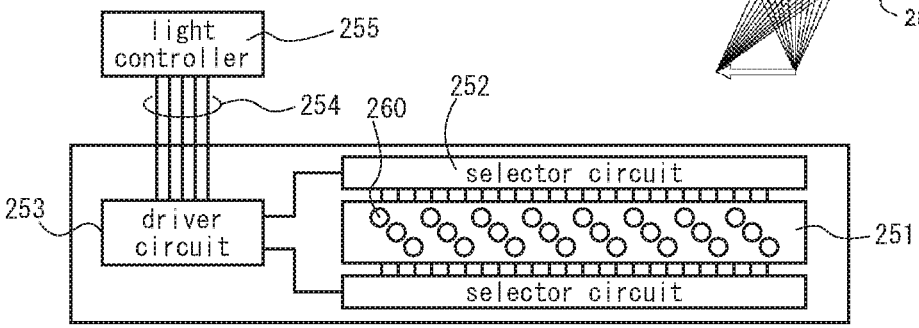
FIG. 2C is a block diagram of a light source panel shown in FIG. 2B.

FIG. 2C is a block diagram of the light source panel 221. An electronic circuit system embedded in the light source panel 221 includes a light-emitting-element array 251, selector circuits 252, and a driver circuit 253. The light-emitting-element array 251 is an array of solid-state light-emitting elements directly formed in the light emission area 301 of the light source panel 221. The example in FIG. 2C has three rows of light-emitting elements 260, which are arranged in a staggered pattern in the longitudinal direction of the light source panel 221. Each of the rows has thousands of light-emitting elements at intervals of tens of micrometers. Each of the light-emitting elements changes its driving current amount according to an external brightness signal. The selector circuits 252 are thin-film-transistor (TFT) circuits directly formed on the light source panel 221, connecting the light-emitting elements in turn with the driver circuit 253. The driver circuit 253 is based on an application-specific integrated circuit (ASIC) or field programmable gate array (FPGA), and implemented in the chip 303 mounted directly on the light source panel 221 (chip on glass: COG). The driver circuit 253 is connected through a flexible printed circuit board (FPC) 254 with a light controller 255 in the printer 100 to receive from the controller digital image data, and converts the image data into analog brightness signals and sends them to light-emitting elements that the selector circuits 252 connect with the driver circuit 253.

—Lens Array—

FIG. 2D is a schematic diagram representing light paths in one 280 of the GRIN lenses in the lens array 222. The GRIN lens 280, which is shaped as a circular pillar made of transparent glass or resin, has a diameter of hundreds of micrometers through some millimeters and a radial gradient of refractive index that reduces from the center axis to the outer circumferential surface in a pattern parabolic in shape. This gradient of refractive index causes a light beam entering one end surface 281 of the GRIN lens 280 to travel along a sinusoidal trajectory in the axial direction of the GRIN lens 280, while repeatedly focusing at regular intervals, e.g. some millimeters through a dozen millimeters. Thus, a light beam ejected from the other end surface 282 of the GRIN lens 280 is focused on an erected or inverted image that depends on the axial length AXL of the GRIN lens 280. In FIG. 2D, erected images appear as shown by white arrows. Blurring of the images is suppressed to an acceptable level within a range of the focus depth DOF of the GRIN lens 280, e.g. hundreds of micrometers.

—Supporting Structure of Photoreceptor Drum—

Figure 4A:
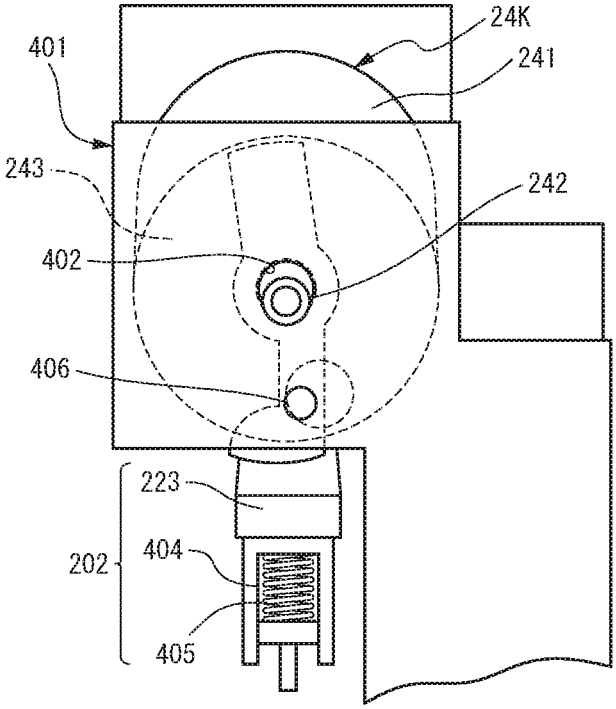
FIG. 4A is a perspective view of appearance of a supporting structure of a photoreceptor drum included in one photoreceptor unit shown in FIG. 1B and FIG. 1C.

FIG. 4A is a perspective view of an appearance of a supporting structure of the photoreceptor drum 24K in one 20K of the photoreceptor units. This view is drawn from a viewpoint slightly above an extension of the center axis 242 of the photoreceptor drum 24K. The other photoreceptor units 20Y, 20M, 20C also have a similar supporting structure.

This supporting structure includes a frame 401, which is disposed outside either end surface 243 of the photoreceptor drum 24K, and extends parallel to the end surface 243. The frame 401 allows its own holes 402 to be penetrated by the ends of the center axis 242 of the photoreceptor drum 24K, and to rotatably support the ends. The frame 401 also has a gap through which the outer circumferential surface 241 of the photoreceptor drum 24K can be partially exposed. The exposed portion is touched by the first transfer roller 22K with the intermediate transfer belt 21 in between.

In the gap of the frame 401, the print head 202 is disposed as shown in FIG. 4A. The print head 202 includes a platform 404 in addition to the elements in FIG. 2A to FIG. 2C. The platform 404 is composed of rigid material, e.g. sheet of metal such as stainless steel (SUS), supporting the bottom surface of the holder 223 from below it. The platform 404 is supported by springs 405, thus supported slidably in the radial direction of the photoreceptor 24K. The springs, for example, shaped as coils, each have an end fixed to the frame 401 and the other end pressing the print head 202 toward the photoreceptor drum 24K by elastic forces of the springs 405 with the platform 404 in between.

Figure 4B:
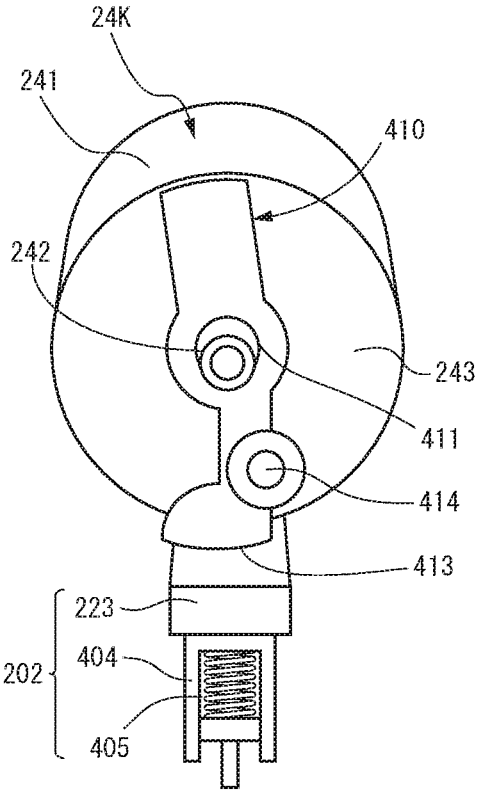
FIG. 4B is a perspective view of an appearance of the supporting structure shown in FIG. 4A when a frame is removed from the supporting structure.
Figure 4C:
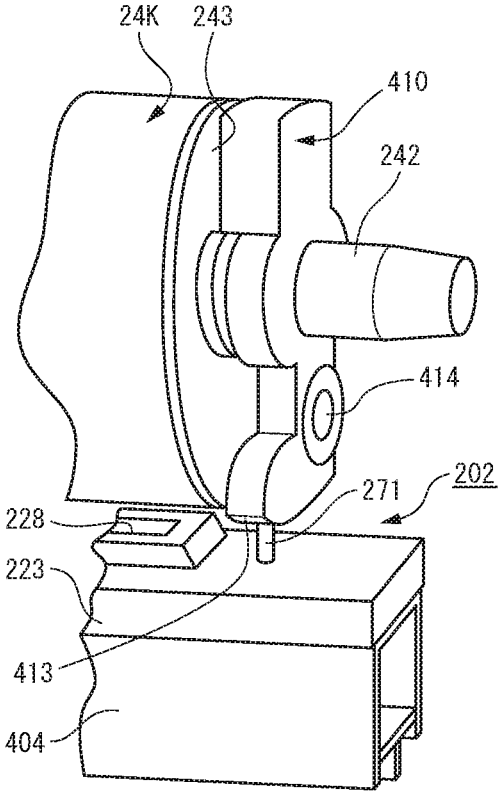
FIG. 4C is a partial perspective view of an end surface and its vicinity of a photoreceptor drum in the same condition as in FIG. 4B from another viewpoint.

FIG. 4B is a perspective view of an appearance of the supporting structure in FIG. 4A when the frame 401 is removed from the supporting structure. FIG. 4C is a partial perspective view of the end surface 243 and its vicinity of the photoreceptor drum 24K in the same condition as in FIG. 4B from another viewpoint. Between either end surface 243 of the photoreceptor drum 24K and the frame 401, a positioning member 410 is mounted, which is a thin elongated rod or plate of rigid material such as metal or hard resin, and integrally formed as a whole. The positioning member 410 includes a center hole 411, which allows an end of the center axis 242 of the photoreceptor drum 24K to penetrate the hole 411, thus supported by the end of the center axis 242 rotatably around the center axis 242. The positioning member 410 has a longitudinal edge, the lower edge 413 in FIG. 4B, with a surface in contact with the surface of the print head 202, its top surface in FIG. 4B, and an intermediate portion 414 between the center hole 411 and the edge 413 screwed to a threaded hole 406 of the frame 401 in FIG. 4A.

As shown in FIG. 4B, the print head 202 receives a force from the spring 405 in the radial direction of the photoreceptor drum 24K, and accordingly moves so that its top surface approaches the center axis 242 of the photoreceptor drum 24K. As shown in FIG. 2A, this top surface has a protrusion 271 at either of its longitudinal ends. The protrusion 271 is a pin of rigid material such as metal or hard resin, and extends from the top surface of the holder 223 in the radial direction of the photoreceptor drum 24K, the positive direction of the Z axis in FIG. 4C. Since the tip surface of the pin 271 touches the edge surface 413 of the positioning member 410, the distance from the center axis 242 of the photoreceptor drum 24K to the print head 202, esp. the holder 223 is limited to the length of the position member 410 from its center hole 411 to its edge surface 413. In other words, this edge surface 413 directly prevents approach of the print head 202 to the photoreceptor drum 24K to limit the distance from the outer circumferential surface 241 of the photoreceptor drum 24K to the holder 223. Thus, the print head 202 is positioned relative to the outer circumferential surface 241 of the photoreceptor drum 24K.

—Positioning of Light Source Panel by Platform—

As shown in FIG. 3A, the platform 404 includes a surface 311 that is substantially flat, i.e. deviated from an ideal plane within an acceptable range. This surface 311 is hereinafter referred to as a "reference face," which faces the first surface 304 of the light source panel 221, its lower surface in FIG. 3A, at a distance from the first surface 304 substantially in parallel to it, i.e. in a position deviated from an ideal parallel position within an acceptable range. The reference face 311 has longitudinal (X-axis) edges supporting both edges of the holder 223. Although not shown in FIG. 3A, the reference face 311 has sides extending in the longitudinal (X-axis) direction and supporting both sides of the holder 223. This results in the elastic force of the spring 405 in FIG. 4A, FIG. 4B being exerted through the platform 404 on the holder 223.

The reference face 311 further supports the light source panel 221 in the vicinity of the light emission area 301. More concretely, the platform 414 includes two positioning members 312, 313, each of which is a pin of rigid material such as metal or hard resin, penetrating the reference face 311, extending towards the light source panel 221, in the positive direction of the Z axis in FIG. 3A, and making its tip touch the vicinity of the light emission area 301 of the light source panel 221, esp. its seal layer 302. On the other hand, the platform 404 includes elastic members on the ends of the reference face 311, which use elastic bodies such as plate springs to push the second (light emission) surface 305, the top surface in FIG. 3A, of the light source panel 221 towards the first (LED-embedded) surface 304, in the negative direction of the Z axis in FIG. 3A. Since the elastic members push the light source panel 221 onto the positioning members 312, 313, the distances from the reference face 311 to the light source panel 221, esp. its light emission surface 305 are limited to values appropriate to how long the positioning members 312, 313 extend from the reference face 311. On the other hand, the distance from the outer circumferential surface 241 of the photoreceptor drum 24K to the reference face 311 is limited by the holder 223 touching the positioning member 410 mounted on the photoreceptor drum 24K. Thus, the light source panel 221, esp. its light emission surface 305 is positioned relative to the outer circumferential surface 241 of the photoreceptor drum 24K.

—Heat Release from Driver Circuit Through Platform—

The driver circuit 253 installed in the light source panel 221 generates a large heat amount, while the light source panel 221 allows heat to be dissipated by heat conduction with poor efficiency because of low thermal conductivity of material of the light source panel 221, e.g. glass. Since space surrounding the light source panel 221 is insulated from outside by the holder 223 and the platform 404, the light source panel 221 also allows heat to be dissipated by radiation to the surroundings and ventilation with poor efficiency. Accordingly, heat generated by the driver circuit 253 can hardly escape from the light source panel 221, and thus, if the panel 221 stores excessive heat amount, there is a high risk of thermal runaway of the driver circuit 253. In order to avoid this risk, a heat conductor 320 is put between the surface of the chip 303, in which the driver circuit 253 is embedded, and the reference face 311 of the platform 404.

The heat conductor 320 is grease of highly heat-conductive resin such as silicone. When the print head 22 is manufactured, the heat conductor 320 is filled in a clearance between the chip 303 and the platform 404 after the light source panel 221 is fixed to the platform 404 in a step of positioning the light source panel 221 relative to the platform 404. Since the heat conductor 320, together with the platform 404, has sufficiently higher heat conductivity than the light source panel 221, most of the heat generated by the driver circuit 253 is dissipated quickly through the heat conductor 320 to the platform 404. This prevents overheating of the light-emitting-element array 251 and the driver circuit 253.

—Heat Release Section of Platform—

In the reference face 311 of the platform 404, a region covered with the heat conductor 320 includes a heat release section 314, which is inclined relative to a flat area of the reference face 311 as shown in FIG. 3A. This entails the surface of the heat release section 314 being positioned at a smaller distance from the surface of the chip 303 in a direction normal to the reference face 311 (the Z-axis direction in FIG. 3A) at a side GNR near to the light emission area 301 in the longitudinal (X-axis) direction of the light source panel 221 (the side of larger X coordinates) than at another side GFR far from the light emission area 301 (the side of smaller X coordinates): GNR<GFR.

Figure 3C:
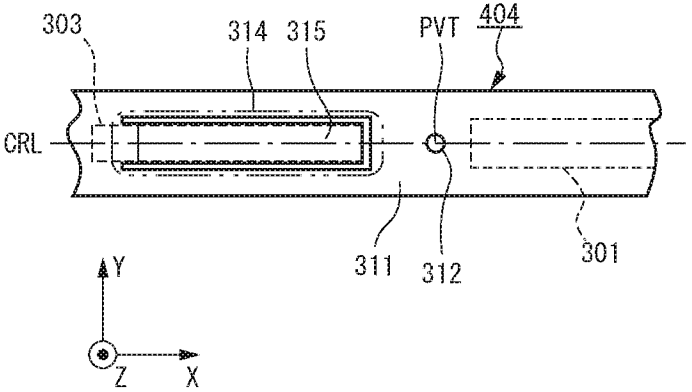
FIG. 3C is a partial, top view of the platform showing the heat release section and its vicinity.
Figure 3B:
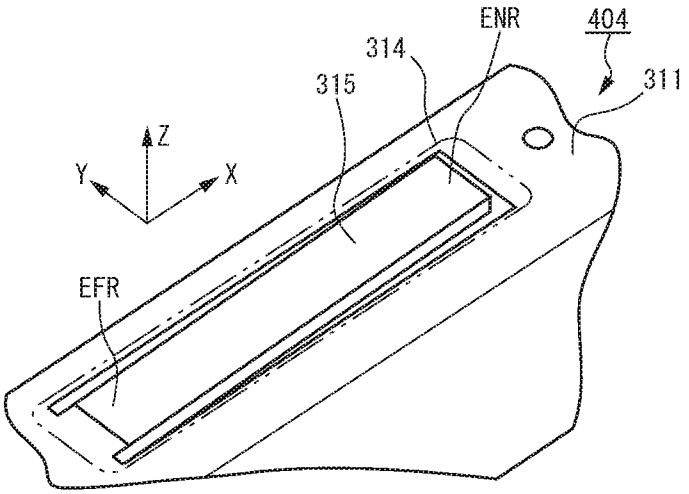
FIG. 3B is a partial, perspective view of a platform showing an appearance of a heat release section and its vicinity as shown in FIG. 3A.

FIG. 3B is a partial, perspective view of the platform 404 showing an appearance of the heat release section 314 and its vicinity. The heat release section 314 includes a bent portion 315 formed by lancing on the reference face 311 of the platform 404. This bent portion 315 is a rectangular piece that is elongated in the longitudinal (X-axis) direction of the light source panel 221, and that is cut and raised from the reference face 311, and has a first edge EFR farther from the light emission area 301 in the longitudinal direction and connected to the substantially flat portion of the reference face 311. The bent portion 315 is bent at the first edge EFR in a direction in which its second edge ENR approaches the light source panel 221, thus inclined relative to the reference face 311. Accordingly, the second edge ENR is nearer to the light source panel 221 than the first edge EFR; the difference in distance from the panel between the edges is, for example, tens to hundreds of micrometers. As a result, the surface of the heat release section 314 is located at a smaller distance from the surface of the chip 303 at a side near to the light emission area 301 in the longitudinal (X-axis) direction of the light source panel 221 than at another side far from the light emission area 301.

FIG. 3C is a partial, top view of the platform 404 showing the heat release section 314 and its vicinity. The bent portion 315 of the heat release section 314 is located directly below the chip 303 mounted on the light source panel 221. See a left rectangular area indicated by broken lines in FIG. 3C. The chip 303 shares with the reference face 311 and its bent portion 315 a center plane CRL in a direction perpendicular to the longitudinal (X-axis) direction of the light source panel 221, the Y-axis direction in FIG. 3C, which is hereinafter also referred to as "transverse direction." On this center plane CRL, one 312 of the positioning members included in the platform 404 is located, which is the nearest to the chip 303 in the longitudinal direction of the light source panel 221. In particular, the portion of the nearest positioning member 312 contact with the seal layer 302 of the light source panel 221, cf. FIG. 3A, is located on the center plane CRL. An area of the reference face 311 opposite to the heat release section 314, a right rectangular area shown by broken lines in FIG. 3C, is located directly below the light emission area 301 of the light source panel 221, which shares a center position in the transverse (Y-axis) direction with the reference face 311.

—Role of Heat Release Section—

The above-described heat release section 314 is located at the area on the reference face 311 of the platform 404 that is covered with the heat conductor 320, and thus reduces deflection of the light source panel 221 caused by pressure from the heat conductor 320 while the heat conductor 320 is being filled into the clearance between the surface of the chip 303 and the reference face 311. This is because of the following reasons.

Figure 5A:
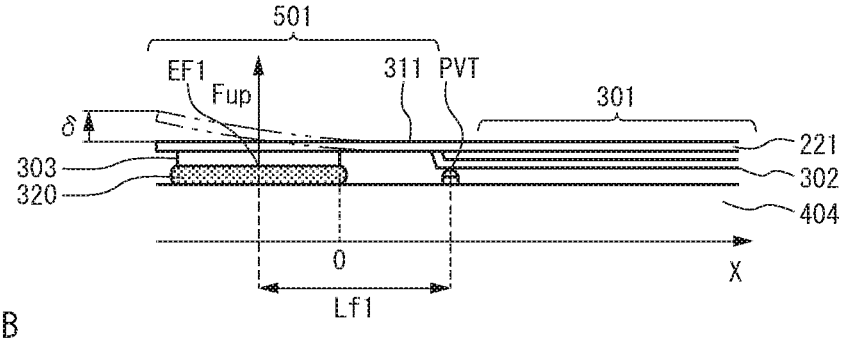
FIG. 5A is a schematic, longitudinal cross-sectional view of a light source panel with a deflection caused by pressure from a heat conductor when a reference face of a platform is flat throughout, i.e., without the heat release section shown in FIG. 3A to FIG. 3C.

FIG. 5A is a schematic, longitudinal cross-sectional view of the light source panel 221 with a deflection caused by pressure from the heat conductor 320 when the reference face 311 of the platform 404 is flat throughout, i.e. without the heat release section 314. As shown in FIG. 3A, the platform 404 uses the two positioning members 312, 313 to support the light emission area 301 and its vicinity of the light source panel 221, esp. the seal layer 302, while the end portion 501 of the light source panel 221 on which the chip 303 is mounted is held in midair until the heat conductor 320 is filled. In this condition, the structure of the end portion 501 can be seen as a cantilever with a fulcrum placed at a point PVT where the nearer of the positioning members 312, 313 touches the seal layer 302. In positioning of the light source panel 221 relative to the platform 404, after the light source panel 221 is fixed to the platform 404, the heat conductor 320 is filled into the clearance between the platform 404 and the chip 303 while the end portion 501 of the light source panel 221 is held in the condition of the cantilever. In this condition, dynamic pressure of the heat conductor 320 flowing into the clearance causes a force pushing the surface of the chip 303, which entails a bending moment exerted on the light source panel 221 around the transverse axis (Y axis) passing through the fulcrum PVT of the cantilever. The bending moment is equal to the integral throughout the length of the chip 303 of the longitudinal (X-axis) distance from the fulcrum PVT to a minute fraction of the chip 303 times the strength of the force pushing the minute fraction. Since the strength of the force can be seen as being substantially constant in the longitudinal (X-axis) direction when the area of the reference face 311 covered with the heat conductor 320 is flat, like other areas of the reference face, the bending moment that the force exerted on each minute fraction of the chip 303 causes on the light source panel 221 is proportional to the distance from the fulcrum PVT to the fraction. Accordingly, a value of the integral Mb1 of the bending moment throughout the length of the chip 303 divided by the strength of the total force Fup exerted on the chip 303 is equal to the distance Lf1 from the fulcrum PVT to the longitudinal (X-axis) center point EF1 of the chip 303: Mb1/Fup=Lf1. In short, the center point EF1 can be seen as the point of load of the total force Fup. The bending moment entails a deflection of the light source panel 221, and in particular, pushes its end portion 501 away from the reference face 311.

Figure 5B:
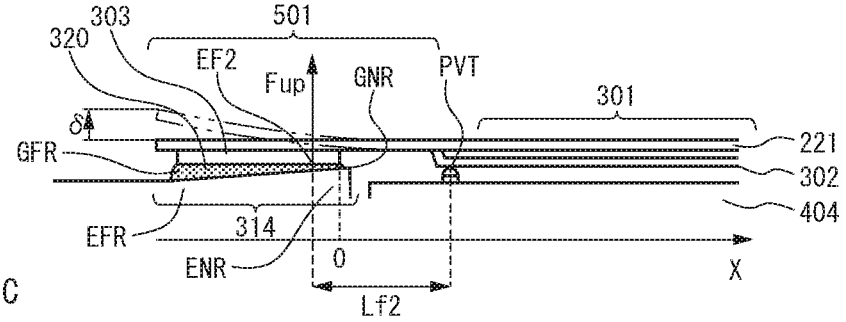
FIG. 5B is a schematic, longitudinal cross-sectional view of deflection of the light source panel caused by force from the heat conductor when the reference face of the platform includes the heat release section.
Figure 5C:
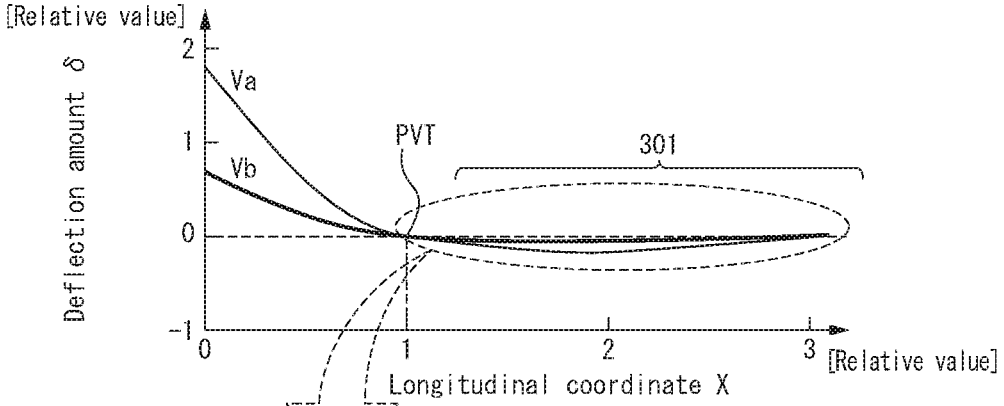
FIG. 5C is a graph showing shapes of deflections of the light source panel.
Figure 5D:
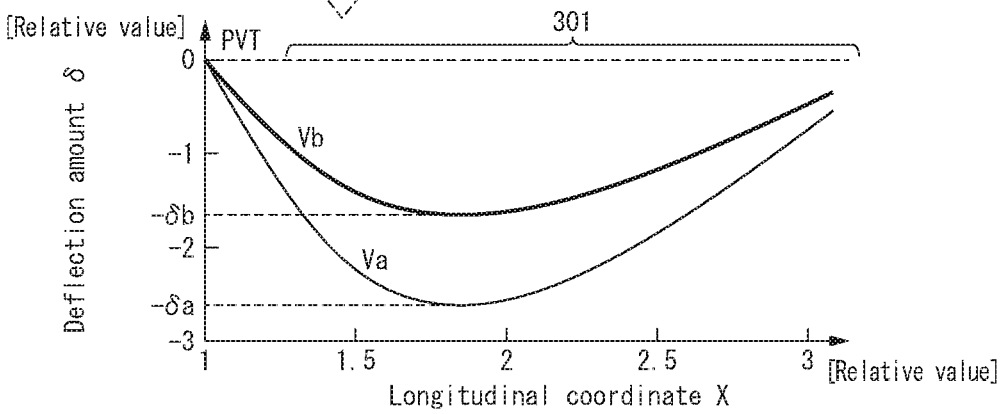
FIG. 5D is an enlarged graph of portions of the deflections in FIG. 5C.

FIG. 5C is a graph showing shapes of deflections of the light source panel 221, and FIG. 5D is an enlarged graph of portions of the deflections in FIG. 5C, the portions appearing in the light emission area 301. The thin-solid curve Va represents a deflection of the light source panel 221 when the entirety of the reference face 311 in FIG. 5A remains flat. The vertical axis indicates amounts δ of deflection of the light source panel 221, i.e. amounts of dislocation in the direction normal to the second (top) surface 305 of the light source panel 221, the vertical direction in FIG. 5A and FIG. 5B. The horizontal axis indicates longitudinal coordinates X of the light source panel 221. The deflection amounts δ are positive when the deflections are in a direction away from the reference face 311, an upward direction in FIG. 5A and FIG. 5B; the deflection amounts δ represent ratios relative to a reference length that is tens to hundreds of micrometers in FIG. 5C, and that is some to tens of micrometers in FIG. 5D. The coordinates X indicate distances from the origin X=0 at the edge of the chip 303 nearest to the light emission area 301 in a unit of a reference length of tens to hundreds of micrometers; the coordinates X are positive when the distances are measured in a direction toward the light emission area 301. As shown in the graph Va, the deflection amounts δ are equal to zero and their signs are reversed at the fulcrum PVT. In other words, the edge 501 of the light source panel 221 is placed away from the reference face 311 while the light emission area 301 is placed close to the reference face 311. As shown in FIG. 5D, the maximum δa of the deflection amounts δ reaches a length up to a dozen to tens of micrometers.

FIG. 5B is a schematic, longitudinal cross-sectional view of the deflection of the light source panel 221 caused by a force from the heat conductor 320 when the reference face 311 of the platform 404 includes the heat release section 314. The bent portion 315 of the heat release section 314 is inclined from the reference face 311 so that the second edge ENR is nearer to the light source panel 221 than the first edge EFR, e.g. by tens to hundreds of micrometers. Accordingly, the gap between the surfaces of the heat release section 314 and the chip 303 is narrower at a side GNR near to the light emission area 301 in the longitudinal (X-axis) direction of the light source panel 221 than at another side GFR far from the light emission area 301. (The near side GNR has X coordinates larger than the far side GFR.) This difference in gap strengthens forces exerted on the surface of the chip 303 at locations nearer the fulcrum PVT of the cantilever in the longitudinal (X-axis) direction; the forces are caused by dynamical pressure of the heat conductor 320 flowing into the gap between the platform 404 and the chip 303 while the heat conductor 320 is being filled in the gap.

The thick-solid curves Vb in FIG. 5C and FIG. 5D represent a deflection of the light source panel 221 when the reference face 311 in FIG. 5B includes the heat release section 314. As shown in FIG. 3C, the reference face 311 and heat release section 314 share a center plane CRL in the transverse (Y-axis) direction of the light source panel 221 with the chip 303 on the light source panel 221. This center plane CRL passes through the contact point PVT between the positioning member 312 of the platform 404 and the seal layer 302 of the light source panel 221. Accordingly, the deflections of the thick-solid curves Vb have shapes substantially independent of transverse (Y-axis) positions. Like the thin-solid curves Va, the thick-solid curves Vb show the deflection amounts δ that are equal to zero and their signs are reversed at the fulcrum PVT. In particular, the light emission area 301 approaches the reference face 311. As shown in FIG. 5D, however, the maximum δb of the deflection amounts δ of the light emission area 301 that the thick-solid curves Vb show is reduced up to 60% of the maximum δa that the thin-solid curves Va show.

This reduction in deflection of the light source panel 221 improves the accuracy of positioning of the light source panel 221, esp. its light emission surface 305 relative to the outer circumferential surface 241. Indeed, the GRIN lenses 280 have tiny depths of focus; especially when the light-emitting elements are OLEDs, which can emit light with lower intensity than LEDs, the GRIN lenses 280 are designed with large F values. This limits their typical depths of focus to around 100 μm. In this case, positioning of the light emission surface 305 is allowed to have a margin of error of around plus or minus 15 μm only, excluding a margin for vibration of the outer circumferential surface 241 and rotation axis of the photoreceptor drum 24K when rotating. Compared with this margin of error, deflection amounts of the light emission area 301 would be large if the entirety of the reference face 311 remained flat. The deflection amounts are, however, suppressed within the margin of positioning error of the light emission face 305 since the heat release section 314 is formed in the reference face 311. Thus, the reduction in deflection of the light emission area 301 due to the heat release section 314 is effective for decrease in error of positioning the light emission face 305 relative to the outer circumferential surface 241 of the photoreceptor drum 24K.

Merit of First Embodiment

In the print head 202 according to the first embodiment of the invention, the platform 404 includes the heat release section 314 in the portion of the reference face 311 covered with the heat conductor 320, as described above. The heat release section 314 is inclined relative to the flat portion of the reference face 311, and located at a smaller distance from the surface of the chip 303 in the (Z-axis) direction normal to the reference face 311 at a side GNR near to the light emission area 301 in the longitudinal (X-axis) direction of the light source panel 221 than at another side GFR far from the light emission area 301. Accordingly, while the heat conductor 320 is being filled in the clearance between the surfaces of the chip 303 and heat release section 314, dynamic pressure of the heat conductor 320 flowing into the clearance causes the forces pushing the surface of the chip 303 to be stronger on the side near to the light emission area 301 in the longitudinal (X-axis) direction of the light source panel 221 than on the side far from the light emission area 301. Because of this biased distribution in strength, the entirety of the forces is applied at the point EF2 that is nearer to the point PVT of contact between the seal layer 302 of the light source panel 221 and the positioning member 312 of the platform 404, which supports the light emission area 301, than the point EF1 of application of the forces if the heat release section 314 were not formed. As a result, the forces provide a smaller bending moment to the light source panel 221 when the reference face 311 includes the heat release section 314 than when the reference face 311 lacks the heat release section 314. Thus, the print head 202 can reduce deflection of the light source panel 221 caused by the forces from the heat conductor 320.

—Modification—

(A) The electrophotographic image forming device 100 in FIG. 1A to FIG. 1C is the color printer of intermediate-transfer type with the tandem photoreceptor units 20Y-20K and the intermediate transfer belt 21. Alternatively, an image forming device according to an embodiment of the invention may be a color printer of direct-transfer type, a monochrome printer, a fax machine, a copier, or a multifunction peripheral (MFP).

(B) The structure of the photoreceptor unit 20K in FIG. 1C is merely one example. For example, the charger section may be a charger of proximity-discharge type with a roller, instead of the charger 201 of corona-discharge type with the electrode 211. The eraser 205 may be closer to the primary transfer roller 22K than the cleaning blade 204.

(C) The outer circumferential surface 241 of the photoreceptor unit 20K in FIG. 1C is covered with photoreceptor. Instead of the drum 24K, the outer circumferential surface of a belt may be covered with photoreceptor. Like the drum 24K, the belt is placed to be surrounded by the charger, developer, cleaning blade, and eraser. During one rotation of the belt, surface portions of the photoreceptor in turn face these sections and undergo their processes of charging, exposure, development, transfer, cleaning, and neutralization. In this case, the positioning member 410 in FIG. 4A to FIG. 4C may be supported by the rotation axis of a pulley driving the belt, instead of the center axis 242 of the drum 24K.

(D) On the light source panel 221 in FIG. 2C, three rows of the solid light-emitting elements 260 are arranged in a staggered pattern in the longitudinal direction of the light source panel 221. The number of light-emitting-element rows may alternatively be one, two, four, or more, and the rows may be arranged in a lattice pattern, instead of a staggered pattern.

(E) The heat release section 314 of the platform 404 in FIG. 3A to FIG. 3C is smoothly inclined relative to the substantially flat portion of the reference face 311. The heat release section 314 may alternatively be deformed relative to the substantially flat portion of the reference face 311 so that distances between the surfaces of the light source panel 221 and chip 303 vary discretely, e.g. stepwise, in the longitudinal (X-axis) direction of the light source panel 221. This deformation only has to result that distances between the surfaces of the heat release section 314 and chip 303 are smaller at the side GNR near to the light emission area 301 in the longitudinal (X-axis) direction of the light source panel 221 than at the side GFR far from the light emission area 301, and dynamic pressure of the heat conductor 320 flowing into the clearance between the surfaces causes the forces to be stronger on the side GNR near to the light emission area 301 than on the side GFR far from the light emission area 301.

(F) The heat release section 314 of the platform 404 in FIG. 3A to FIG. 3C includes the bent portion 315 cut and raised from the reference face 311 by lancing, whose portion around the second edge ENR nearer to the light emission area 301 in the longitudinal (X-axis) direction of the light source panel 221 is separated from the flat portion of the reference face 311. Accordingly, most of heat escaping from the chip 303 through the heat conductor 320 to the heat release section 314 does not dissipate from the second edge ENR to the light emission area 301, but does from the first edge EFR to the side opposite to the light emission area 301. Thus, the bent portion 315 also has an additional effect of reducing a risk that heat once escaping from the chip 303 to the heat release section 314 reaches the light emission area 301 through the platform 404.

Nevertheless, when this effect is less important, the heat release section may include a portion formed by drawing, instead of the bent portion 315.

Figure 6A:
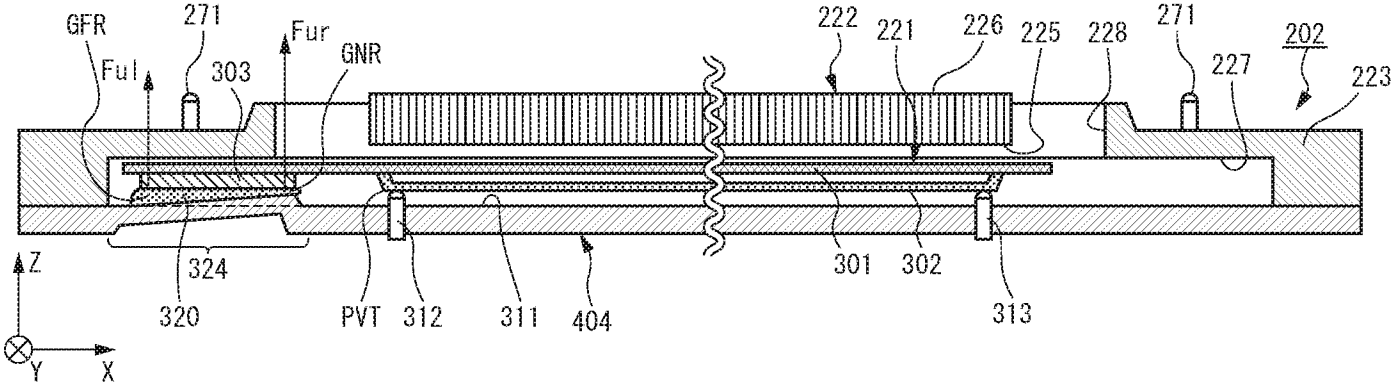
FIG. 6A is a longitudinal cross-sectional view of a modification of a print head.

FIG. 6A is a longitudinal cross-sectional view of a modification of the print head 202. A portion of the reference face 311 of the platform 404 covered with the heat conductor 320 includes a heat release section 324, which is inclined relative to the flat portion of the reference face 311 to the same side as the heat release section in FIG. 3A. Accordingly, distances between the surfaces of the heat release section 324 and chip 303 in a direction normal to the reference face 311 (the Z-axis direction in FIG. 6A) are smaller at a side GNR near to the light emission area 301 in the longitudinal (X-axis) direction of the light source panel 221 (the side of smaller X coordinates) than at another side GFR far from the light emission area 301 (the side of larger X coordinates): GNR <GFR.

Figure 6C:
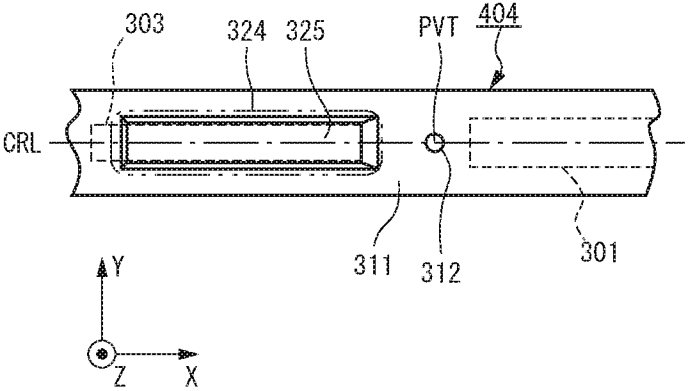
FIG. 6C is a partial top view of the platform showing the heat release section and its vicinity.
Figure 6B:
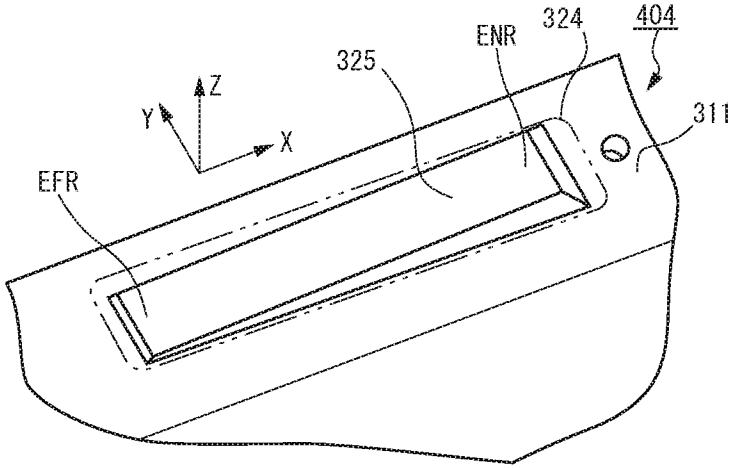
FIG. 6B is a partial perspective view of an appearance of a platform around a heat release section.

FIG. 6B is a partial perspective view of an appearance of the platform 404 around the heat release section 324. The heat release section 324 includes a bump 325 formed in the reference face 311 of the platform 404. The bump 325 is a rectangular piece that is elongated in the longitudinal (X-axis) direction of the light source panel 221, and that is drawn from the reference face 311. In contrast to the bent portion in FIG. 3A to FIG. 3C, the bump 325 remains, throughout its perimeter, connected to the flat portion of the reference face 311. The bump 325 has a surface inclined relative to the flat portion of the reference face 311 so that a portion of the surface nearer to the light emission area 301 in its longitudinal (X-axis) direction is higher, i.e. located at a smaller distance from the light source panel 221 in its normal (Z-axis) direction. In particular, a second edge ENR of the bump 325 near to the light emission area 301 is closer to the light source panel 221 than a first edge EFR of the bump 325 far from the light emission area 301; the difference in distance from the panel between the edges is, for example, tens to hundreds of micrometers. As a result, as shown in FIG. 6A, a surface portion of the heat release section 324 nearer to the light emission area 301 in the longitudinal (X-axis) direction is located at a smaller distance from the surface of the chip 303.

FIG. 6C is a partial top view of the platform 404 showing the heat release section 324 and its vicinity. The bump 325 of the heat release section 324 is located directly below the chip 303 mounted on the light source panel 221. See a left rectangular area shown by broken lines in FIG. 6C. The chip 303 shares a center plane CRL in the transverse (Y-axis) direction of the light source panel 221 with the reference face 311. On this center plane CRL, one 312 of the positioning members included in the platform 404 is located, which is the nearest to the chip 303 in the longitudinal direction of the light source panel 221. In particular, the portion of the nearest positioning member 312 in contact with the seal layer 302 of the light source panel 221, cf. FIG. 6A, is located on the center plane CRL. An area of the reference face 311 opposite to the heat release section 324, a right rectangular area shown by broken lines in FIG. 6C, is located directly below the light emission area 301 of the light source panel 221.

Since the heat release section 324 formed by drawing is inclined in the same manner as one 314 formed by lancing, a portion of the heat release section 324 nearer to the light emission area 301 in the longitudinal (X-axis) direction of the light source panel 221 is located at a smaller distance from the surface of the chip 303. Accordingly, while the heat conductor 320 is being filled in the clearance between the surfaces of the chip 303 and heat release section 324, dynamic pressure of the heat conductor 320 flowing into the clearance causes the forces pushing the surface of the chip 303 to be stronger on the side near to the light emission area 301 in the longitudinal (X-axis) direction than on the side far from the light emission area 301. Because of this biased distribution in strength, the total of the forces is applied at the point EF2 that is nearer to the point PVT of contact between the seal layer 302 of the light source panel 221 and the positioning member 312 of the platform 404, which supports the light emission area 301, than the point EF1 of application of the forces evenly distributed. As a result, the forces provide a smaller bending moment to the light source panel 221. Thus, the heat release section 324 formed by drawing, like one 314 formed by lancing, enables the print head 202 to reduce deflection of the light source panel 221 caused by the forces from the heat conductor 320.

As shown in FIG. 3A, the platform 404 includes the two positioning members 312, 313, which touch the seal layer 302 of the light source panel 221 on the center plane CRL in the transverse (Y-axis) direction of the light source panel 221. Alternatively, a platform may include three or more similar positioning members.

Figure 7A:
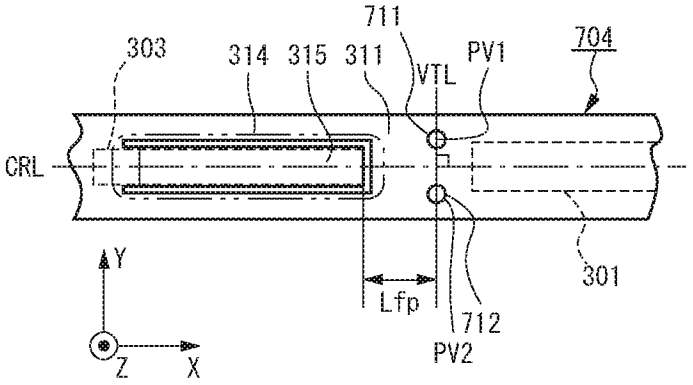
FIG. 7A is a partial top view of a heat release section and its vicinity for an example of a platform including three or more positioning members.

FIG. 7A is a partial top view of such a first platform 704 showing the heat release section 314 and its vicinity. The first platform 704 includes two positioning members 711, 712 nearest to the chip 303 in the longitudinal (X-axis) direction. These positioning members 711, 712 have points PV1, PV2 of contact with the seal layer 302 of the light source panel 221; the points PV1, PV2 are located at the same distance Lfp from the heat release section 314 in the longitudinal (X-axis) direction. A straight line VTL passing through both the contact points PV1, PV2 is perpendicular to the longitudinal (X-axis) direction of the heat release section 314. Since the chip 303 shares the transverse center plane CRL with the reference face 311, the heat release section 314 is also centered on the transverse center plane CRL. The two contact points PV1, PV2 are disposed symmetrically with respect to the center plane CRL. As a result, the deflection of the light source panel 221 has a shape (cf. the thick-solid curves Vb in FIG. 5C, and FIG. 5D) substantially independent of transverse positions. This is also true when there is an even number greater than two of positioning members nearest to the chip 303 in the longitudinal (X-axis) direction.

Figure 7B:
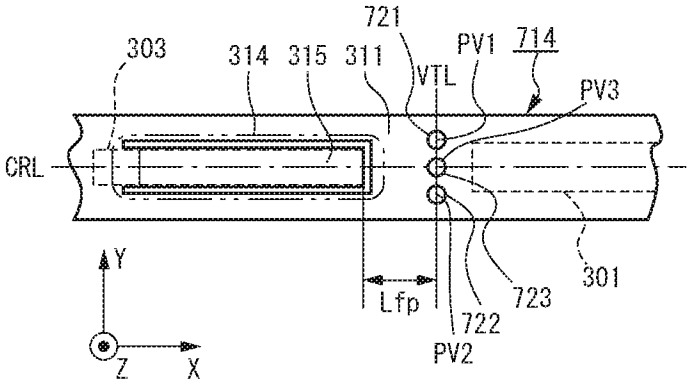
FIG. 7B is a partial top view of a heat release section and its vicinity for another example of a platform.

FIG. 7B is a partial top view of a second platform 714 showing the heat release section 314 and its vicinity. The second platform 714 includes three positioning members 721, 722, 723, nearest to the chip 303 in the longitudinal (X-axis) direction. These positioning members 721-723 have points PV1, PV2, PV3 of contact with the seal layer 302 of the light source panel 221; the points PV1-PV3 are located at the same distance Lfp from the heat release section 314 in the longitudinal (X-axis) direction. A straight line VTL passing through all the contact points PV1-PV3 is perpendicular to the longitudinal (X-axis) direction of the heat release section 314. Since the chip 303 shares the transverse center plane CRL with the reference face 311, the heat release section 314 is also transversally centered on the transverse center plane CRL. Among the three contact points PV1-PV3, both the end ones PV1, PV2 are disposed symmetrically with respect to the center plane CRL, and the center one PV3 is placed on the center plane CRL. As a result, the deflection of the light source panel 221 has a shape (cf. the thick-solid curves Vb in FIG. 5C, FIG. 5D) substantially independent of transverse positions. This is also true when there is an odd number greater than three of positioning members nearest to the chip 303 in the longitudinal (X-axis) direction.

Figure 7C:
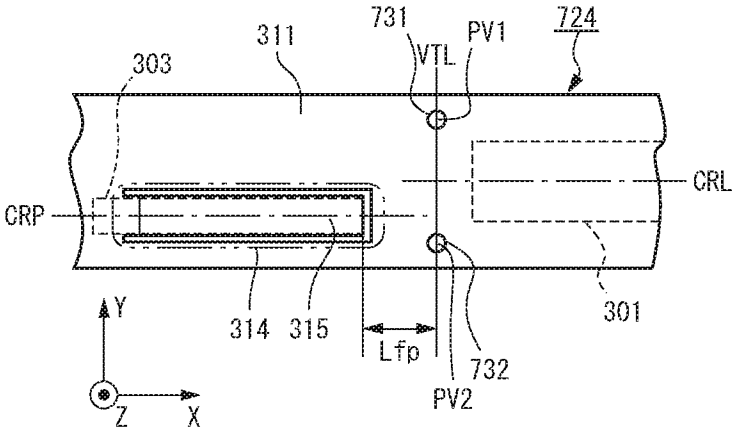
FIG. 7C is a partial top view of a heat release section and its vicinity for another example of a platform.

FIG. 7C is a partial top view of a third platform 724 showing the heat release section 314 and its vicinity. The third platform 724, like the first one 704 in FIG. 7A, includes two positioning members 731, 732 nearest to the chip 303 in the longitudinal (X-axis) direction. These positioning members 731, 732 have points PV1, PV2 of contact with the seal layer 302 of the light source panel 221; the points PV1, PV2 are located at the same distance Lfp from the heat release section 314 in the longitudinal (X-axis) direction. A straight line VTL passing through both the contact points PV1, PV2 is perpendicular to the longitudinal (X-axis) direction of the heat release section 314. However, the chip 303 has its transverse center plane CRP at a position different from the transverse center plane CRL of the reference face 311 and the light emission area 301. Since transversally centered at the same position as the chip 303, the heat release section 314 has its transverse center at a position different from the reference face 311 and the light emission area 301. In this case, one PV1 of the two contact points is disposed outside the chip 303 and the heat release section 314, and the other PV2 is on the opposite side of the chip 303 and the heat release section 314. Since this arrangement reduces torsion of the light source panel 221 around its transverse center line CRL caused by the forces from the heat conductor 320, deflections of the light source panel 221 only have transverse changes within an acceptable range. This is also true when there are three or more positioning members nearest to the chip 303 in the longitudinal (X-axis) direction.

Second Embodiment

Figure 8A:
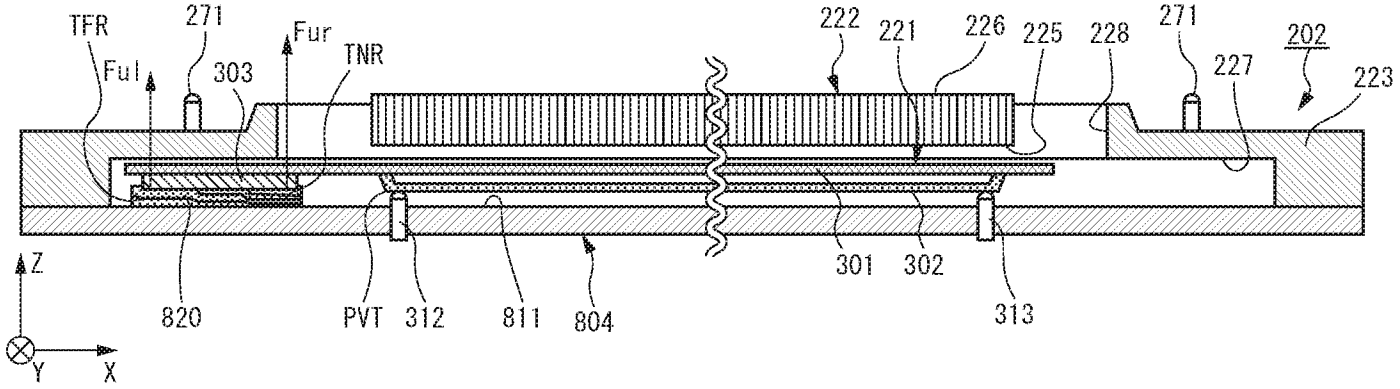
FIG. 8A is a longitudinal cross-sectional view of a print head according to a second embodiment of the invention.
Figure 8B:
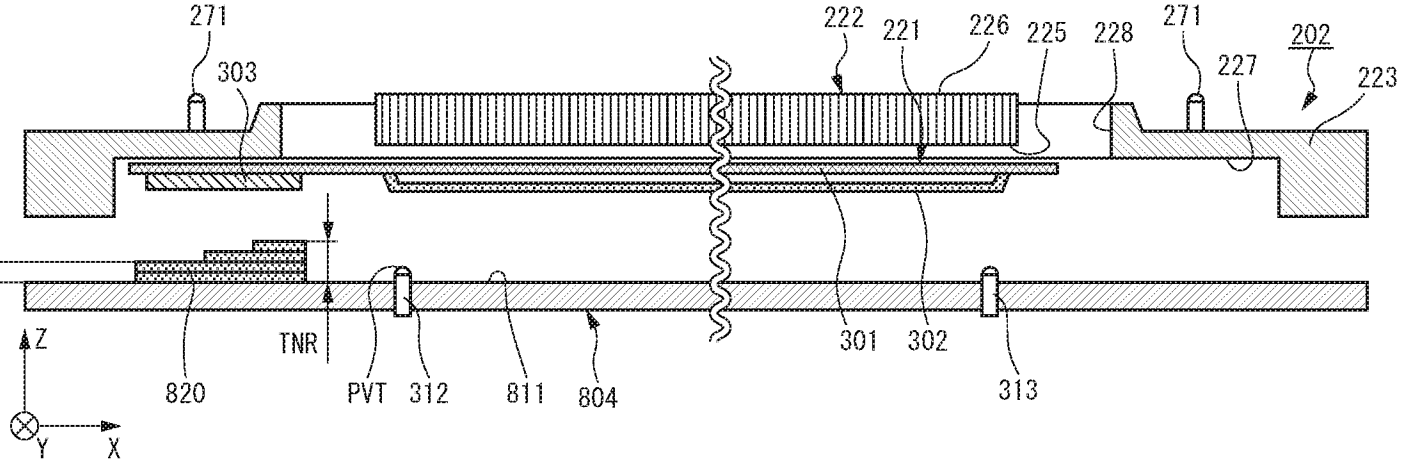
FIG. 8B is a longitudinal cross-sectional view of the print heat when its light source panel and holder are separated from a platform.

FIG. 8A is a longitudinal cross-sectional view of a print head 802 according to a second embodiment of the invention, and FIG. 8B is a longitudinal cross-sectional view of the print head 802 when its light source panel 221 and holder 223 are separated from a platform 804. This print head 802 has the same structure as the print head 202 according to the first embodiment, except for the structure of a portion of a reference face 811 of the platform 804 covered with heat conductor 820. This different structure will be explained below. Explanation about the other same structures can be found in the description of the first embodiment.

As shown in FIG. 8A, the reference face 811 of the platform 804 remains flat as a whole. In contrast to the reference face 311 in FIG. 3A, the portion of the reference face 811 covered with the heat conductor 820, together with other portions, substantially remains flat without the heat release section 314. On the other hand, the heat conductor 820 is a piece of rubber or a sheet made of high thermal conductive resin such as silicone, in contrast to the grease-based heat conductor 320. The heat conductor 820 has a laminated body on the surface of the chip 303 or a portion of the reference face 811 facing the surface of the chip 303 as shown in FIG. 8B. When the print head 802 is assembled, the laminated body is formed in a step of positioning the light source panel 221 relative to the platform 804, for example, before the light source panel 221 is fixed to the reference face 811 of the platform 804, and then the surface of the chip 303 and the reference face 811 are attached to each other with the heat conductor 820 in between when the light source panel 221 is pressed onto the reference face 811. Since the heat conductor 820 has a sufficiently higher thermal conductivity than the light source panel 221, most of heat generated by the driver circuit 253 is rapidly dissipated through the heat conductor 820 to the platform 804. This prevents overheating of the driver circuit 253 and the light-emitting-element array 251.

When the light source panel 221 and holder 223 are separated from the platform 804 as shown in FIG. 8B, the heat conductor 820 has a thicker portion at a side TNR near to the light emission area 301 in the longitudinal (X-axis)

direction of the light source panel 221 (the side of larger X coordinates) than at another side TFR far from the light emission area 301 (the side of smaller X coordinates). Because of this change in thickness in the longitudinal (X-axis) direction, the heat conductor 820 has larger amounts of compression at the side TNR near to the light emission area 301 in the longitudinal (X-axis) direction than at the side TFR far from the light emission area 301, as shown in FIG. 8A, when the light source panel 221 and holder 223 are separated from the platform 804. As a result, the strength Fur of a force received by the surface of the chip 303 from the side TNR of the heat conductor 820 near to the light emission area 301 in the longitudinal (X-axis) direction is larger than the strength Ful of a force received by the surface of the chip 303 from the side TFR far from the light emission area 301: Fur>Ful. Difference Fur−Ful in the forces is adjustable for, e.g., the elastic modulus and thickness distribution of the heat conductor 820. The forces provide a bending moment Mb3 to the light source panel 221; this bending moment Mb3 divided by the strength of the total force Fup exerted on the chip 303 is equal to the distance Lf3 from the fulcrum PVT of the cantilever to the point EF3 of application of the total force Fup; this distance Lf3 is smaller than the distance Lf1 from the fulcrum PVT to the point EF1 of application of the total force Fup if the heat conductor had a uniform thickness, i.e. the longitudinal (X-axis) center point EF1 of the chip 303: Mb3/Fup=Lf3<Lf1. In short, the point EF3 of application of the total force Fup is closer to the light emission area 301 than the center point EF1 of the chip 303. When the total force Fup exerted by the heat conductor on the chip 303 can be seen as being constant regardless of the thickness distributions of heat conductors, the heat conductor of uneven thickness applies a smaller bending moment to the light source panel 221 than the heat conductor of even thickness: Mb3=Fup·Lf3<Fup·Lf1. Thus, deflection of the light source panel 221 is reduced as a whole.

Merit of Second Embodiment

In the print head 802 according to the second embodiment of the invention, the heat conductor 820 has a thicker portion at the side TNR near to the light emission area 301 in the longitudinal (X-axis) direction of the light source panel 221 than at the side TFR far from the light emission area 301 when the light source panel 221 and holder 223 are separated from the platform 804, as described above. Accordingly, when the surface of the chip 303 and the reference face 811 are attached to each other with the heat conductor 820 in between, the heat conductor 820 exerts a stronger force on the side of the chip 303 near to the light emission are 301 in the longitudinal (X-axis) direction of the light source panel 221 than on the side of the chip 303 far from the light emission area 301. Because of this biased distribution in strength, the total force is applied at the point EF3 that is nearer to the point PVT of contact between the seal layer 302 of the light source panel 221 and the positioning member 312 of the platform 404, which supports the light emission area 301, than the point EF1 at which the heat conductor of even thickness applies the total force. As a result, the total force provides a smaller bending moment to the light source panel 221 when the heat conductor has uneven thickness than when the heat conductor has even thickness. Thus, the print head 802 can reduce deflection of the light source panel 221 caused by the forces from the heat conductor 820.

—Supplement—

Based on the above-described embodiments, the invention may be further characterized as follows.

The heat release section may include a bent portion that is cut and raised from the face of the platform and inclined relative to the substantially flat portion of the face. A side of the bent portion nearer to the light emission area in the longitudinal direction of the light source panel may be closer to the surface of the chip in a direction normal to the face than another side of the bent portion farther from the light emission area. The bent portion may have an edge that is located farther from the light emission area in the longitudinal direction of the light source panel and connected to the substantially flat portion of the face of the platform.

The heat release section may include a bump drawn from the face of the platform. The bump may have a surface that is inclined relative to the substantially flat portion of the face and a side of the bump nearer to the light emission area in the longitudinal direction of the light source panel is closer to the surface of the chip in a direction normal to the face than another side of the bump farther from the light emission area.

The platform may include one or more positioning members with one or more tips protruding from the face and touching the light source panel in a vicinity of the light emission area to limit the position of the light source panel. Among the one or more positioning members, the nearest one to the chip in the longitudinal direction of the light source panel may have a point contact with the light source panel at the same position in the transverse direction of the light source panel as the center of the chip. Among the one or more positioning members, one or more of the nearest ones to the chip in the longitudinal direction of the light source panel may have one or more points contact with the light source panel, and the center of the points may locate at the same position in the transverse direction of the light source panel as the center of the chip. In the transverse direction of the light source panel, the center of the chip may locate at a position different from the center of the light emission area, and, among the one or more positioning members, one or more of the nearest ones to the chip in the longitudinal direction of the light source panel may include one farther from the center of the light emission area than the chip and one at an opposite side of the center of the light emission area to the chip. The light source panel may further include a sealing member hermetically enclosing the light emission area in insulation from outside, and the one or more positioning members may have tips touching the sealing member to limit the position of the light source panel.

The print head may further include a lens array allowing transmission therethrough of light from the light emission area, and a holder member holding the lens array. The light emission area may include a plurality of light emission elements arranged along the longitudinal direction. The light emission elements may include organic light emitting diodes.

Although one or more embodiments of the present invention have been described and illustrated in detail, the disclosed embodiments are made for the purposes of illustration and example only and not limitation. The scope of the present invention should be interpreted by the terms of the appended claims.

What is claimed is:

1. A print head comprising:

a light source panel shaped as an elongated plate, including a light emission area extending in the longitudinal direction of the plate and a chip that is mounted on an edge portion of the plate in the longitudinal direction and incorporates a driver circuit for the light emission area;

a platform with a substantially flat face, supporting the light source panel in a vicinity of the light emission area to position the light source panel substantially parallel to the face at a predetermined distance from the face; and a heat conductor heat-conductively connecting between a surface of the chip and the face of the platform, the heat conductor covering a portion of the face of the platform that includes a heat release section deformed relative to the substantially flat portion of the face of the platform wherein a side of the heat release section nearer to the light emission area in the longitudinal direction of the light source panel is closer to the surface of the chip in a direction normal to the face than another side of the heat release section farther from the light emission area.

2. The print head according to claim 1, wherein the heat release section includes a bent portion that is cut and raised from the face of the platform and inclined relative to the substantially flat portion of the face, wherein a side of the bent portion nearer to the light emission area in the longitudinal direction of the light source panel is closer to the surface of the chip in a direction normal to the face than another side of the bent portion farther from the light emission area.

3. The print head according to claim 2, wherein the bent portion has an edge that is located farther from the light emission area in the longitudinal direction of the light source panel and connected to the substantially flat portion of the face of the platform.

4. The print head according to claim 1, wherein the heat release section includes a bump drawn from the face of the platform.

5. The print head according to claim 4, wherein the bump has a surface that is inclined relative to the substantially flat portion of the face and a side of the bump nearer to the light emission area in the longitudinal direction of the light source panel is closer to the surface of the chip in a direction normal to the face than another side of the bump farther from the light emission area.

6. A print head comprising:

a light source panel shaped as an elongated plate, including a light emission area extending in the longitudinal direction of the plate and a chip that is mounted on an edge portion of the plate in the longitudinal direction and incorporates a driver circuit for the light emission area;

a platform with a substantially flat face, supporting a vicinity of the light emission area of the light source panel to locate the light source panel substantially parallel to the face at a predetermined distance from the face; and a heat conductor heat-conductively connecting between a surface of the chip and the face of the platform, the heat conductor being thicker at a side near to the light emission area in the longitudinal direction of the light source panel than at another side far from the light emission area when the heat conductor is disconnected from either the surface of the chip or the face of the platform.

7. The print head according to claim 1, wherein the platform includes one or more positioning members with one or more tips protruding from the face and touching the light source panel in a vicinity of the light emission area to limit the position of the light source panel.

8. The print head according to claim 7, wherein, among the one or more positioning members, the nearest one to the chip in the longitudinal direction of the light source panel has a point contact with the light source panel at the same position in the transverse direction of the light source panel as the center of the chip.

9. The print head according to claim 7, wherein, among the one or more positioning members, one or more of the nearest ones to the chip in the longitudinal direction of the light source panel have one or more points contact with the light source panel, and the center of the points locates at the same position in the transverse direction of the light source panel as the center of the chip.

10. The print head according to claim 7, wherein, in the transverse direction of the light source panel, the center of the chip locates at a position different from the center of the light emission area, and, among the one or more positioning members, one or more of the nearest ones to the chip in the longitudinal direction of the light source panel include one farther from the center of the light emission area than the chip and one at an opposite side of the center of the light emission area to the chip.

11. The print head according to claim 7, wherein the light source panel further includes a sealing member hermetically enclosing the light emission area in insulation from outside, and the one or more positioning members have tips touching the sealing member to limit the position of the light source panel.

12. The print head according to claim 1, further comprising:

a lens array allowing transmission therethrough of light from the light emission area; and a holder member holding the lens array, wherein the light emission area includes a plurality of light emission elements arranged along the longitudinal direction.

13. The print head according to claim 12, wherein the light emission elements include organic light emitting diodes.

14. An image forming apparatus of an electrophotographic type comprising:

a photoreceptor;

a print head exposing a surface of the photoreceptor to a light beam to form an electrostatic latent image on the surface;

a developer converting the latent image to a visible image with toner; and a transfer device transferring the visible image from the photoreceptor to a sheet, the print head comprising:

a light source panel shaped as an elongated plate, including a light emission area extending in the longitudinal direction of the plate and a chip that is mounted on an edge portion of the plate in the longitudinal direction and incorporates a driver circuit for the light emission area;

a platform with a substantially flat face, supporting the light source panel in a vicinity of the light emission area to position the light source panel substantially parallel to the face at a predetermined distance from the face; and a heat conductor heat-conductively connecting between a surface of the chip and the face of the platform, the heat conductor covering a portion of the face of the platform that includes a heat release section deformed relative to the substantially flat portion of the face of the platform wherein a side of the heat release section nearer to the light emission area in the longitudinal direction of the light source panel is closer to the surface of the chip in a direction normal to the face than another side of the heat release section farther from the light emission area.

15. An image forming apparatus of an electrophotographic type comprising:

a photoreceptor;

a print head exposing a surface of the photoreceptor to a light beam to form an electrostatic latent image on the surface;

a developer converting the latent image to a visible image with toner; and a transfer device transferring the visible image from the photoreceptor to a sheet, the print head comprising:

a light source panel shaped as an elongated plate, including a light emission area extending in the longitudinal direction of the plate and a chip that is mounted on an edge portion of the plate in the longitudinal direction and incorporates a driver circuit for the light emission area;

a platform with a substantially flat face, supporting the light source panel in a vicinity of the light emission area to position the light source panel substantially parallel to the face at a predetermined distance from the face; and a heat conductor heat-conductively connecting between a surface of the chip and the face of the platform, the heat conductor being thicker at a side near to the light emission area in the longitudinal direction of the light source panel than at another side far from the light emission area when the heat conductor is disconnected from either the surface of the chip or the face of the platform.

* * * * *